United States Patent [19]

Day

[11] Patent Number: 4,920,003

[45] Date of Patent: Apr. 24, 1990

[54] DI-TRIDECYL SEBACATE TIRE YARN FINISH

[75] Inventor: Fleming H. Day, Greenville, N.C.

[73] Assignee: E. I. Du Pont de Nemours and Company, Wilmington, Del.

[21] Appl. No.: 73,531

[22] Filed: Jul. 15, 1987

[51] Int. Cl.[5] ..... B32B 9/00; D02G 3/02

[52] U.S. Cl. ..... 428/391; 252/8.6; 252/8.8; 252/8.9; 428/395; 57/250; 57/258

[58] Field of Search ..... 428/395, 391, 375, 378; 252/8.6, 8.9, 56, 51.5 A, 8.8; 8/580, 581, 115.62, 115.6; 57/250, 258

[56] References Cited

U.S. PATENT DOCUMENTS

| | | | |
|---|---|---|---|
| 3,827,114 | 8/1974 | Crossfield | 28/75 |
| 4,115,621 | 9/1978 | Hawkins | 428/395 |
| 4,252,528 | 2/1981 | Decker et al. | 8/115.6 |
| 4,789,381 | 12/1988 | Oshiyama et al. | 8/115.6 |

OTHER PUBLICATIONS

Research Disclosure 19520, Jul., 1980.
Research Disclosure 17216, Aug., 1978.
Research Disclosure 17105, Jul., 1978.
Research Disclosure 16949, May., 1978.

*Primary Examiner*—Lorraine T. Kendell

[57] ABSTRACT

A fiber finish especially suitable for tire yarns having 50–95% lubricants with at least 40% of the lubricants comprising ditridecyl sebacate and the yarns containing the finish are disclosed.

6 Claims, 1 Drawing Sheet

DI-TRIDECYL SEBACATE TIRE YARN FINISH

TECHNICAL FIELD

Figure 1:
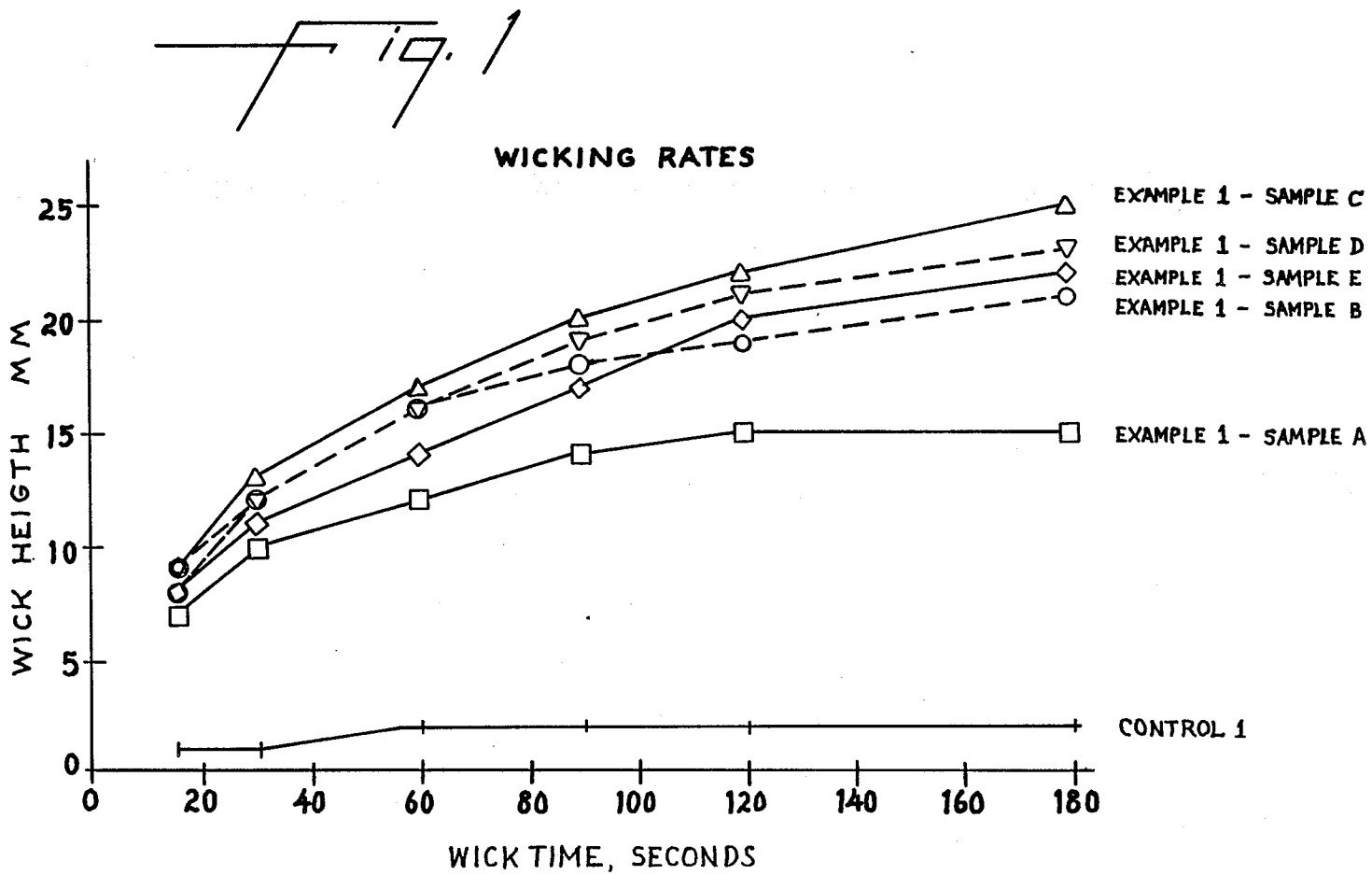

This invention relates to a fiber finish especially suitable for tire yarns comprising 50–95 wt. % lubricants having a melting point not greater than about 12° C. wherein at least 40 wt. % of the lubricants is ditridecyl sebacate, 5–50 wt. % of the finish is a total of surfactant and antistat, 0–5 wt. % of the finish is antioxidant and 0–2 wt. % of the finish is a polysiloxane.

BACKGROUND

When commonly available nylon industrial yarns, as tire cord or in tire cord fabric form, are dipped in aqueous resorcinal-formaldehyde-latex (RFL) mixtures at low temperatures (<25° C.), the cord or cord fabric so formed has relatively poor adhesion to rubber stock. Typical lubricants in finishes on such yarns which give the poor adhesion at low temperatures are triglycerides, like coconut oil and rearranged unsaturated triglycerides. The adhesion problem becomes particularly acute as the temperature approaches 0° C. The poor adhesion is believed to be caused by the relatively low pickup of the RFL material. A yarn or yarn finish which solves this cold weather adhesion problem would be desirable.

SUMMARY OF THE INVENTION

A fiber finish especially suitable for tire yarns comprising at least 50–95 wt. % lubricants having a melting point not greater than about 12° C. wherein at least 40 wt. % of the lubricant is ditridecyl sebacate, 5–50 wt. % of the finish is a total of surfactant and antistat, 0–5 wt. % of the finish is antioxidant and 0–2 wt. % of the finish is a polysiloxane has now been discovered. A polyamide yarn especially suitable as a tire yarn having 0.2–2% of this finish having a hot (120° C.) 2-ply adhesion of greater than 20 lbs. per inch at an RFL bath solids level of 5% is preferred.

The relatively low pick-up of RFL material at low temperatures by nylon industrial yarns is believed to be caused by the water repelling action of the relatively hydrophobic lubricant in the finish on the nylon yarn. It is further believed that an important element in this water repelling action of the lubricant is the fact that it tends to solidify at <25° C. and forms a solid film which tends to reduce dip wicking and, hence, result in significantly lower dip pick up.

It has now been discovered that nylon yarn finishes formulated with ditridecyl sebacate (DTS) lubricant are effective in RFL dipping operations when cord or fabric temperatures are at 0° C. or even lower. Nylon yarns with such finishes show good wicking at low temperatures, which is predictive of good RFL dip pickup. DTS is a diester of sebacic acid ($C_{10}$), where the alcohol component is a highly branched $C_{13}H_{27}$—OH moiety; the major isomer of the alcohol is tetramethylnonyl alcohol. The freezing point of DTS is not known, but must be very low, since the pour point is less than −50° C., which is surprisingly low for such a high molecular weight structure. Because of its very low freezing point, it is believed that DTS in a finish on yarn retains its liquid character at temperatures as low as 0° C. and below and thus allows reasonably facile uptake of RFL materials at low temperatures. DTS can be used in combination with other lubricants with melting points not greater than about 12° C. At least 40% of the lubricants should be DTS.

A preferred finish is comprised of 50–95 wt.% of DTS, 5–50 wt.% total of surfactant and antistat, and 0–5% of other optional ingredients, such as antioxidants and substituted polysiloxanes. This finish composition can be used on a wide range of fibers such as but not limited to polyamides and polyesters. A preferred embodiment of this invention is polyamide tire yarn containing 0.2 to 2% of this finish. Especially preferred polyamides are polyhexamethylene adipamide, polycapramide and polytetramethylene adipamide and copolymers thereof.

5–50 wt. % of the finish is the total of surfactant and antistat. This may be a single component which has both surfactant and antistat characteristics or it may be a combination of two or more materials which provided surfactant and antistat properties separately. Antistats are materials in the finish which dissipate the accumulated static charge on the fiber or threadline. Examples are phosphate esters, quaternary ammonium compounds or ethylene oxide adducts of hydrophobic organic groups. A surfactant is another key component of a finish which improves the wetting properties of the yarn. Typically, it has a hydrophobic group and a hydrophilic group in the same molecule. Good examples of suitable hydrophobic groups are sorbitol and sorbitan esters. Commonly, polyoxyethylene is uses as the hydrophilic group. The proper balance of hydrophilic and hydrophobic groups, as well as the molecular weight, are chosen to provide the desired wetting properties, compatibility with other finish components and suitably low fuming during hot processing steps. Examples of materials which provide both antistat and surfactant properties are sorbitan trioleate adduct with 20 moles of ethylene oxide, sorbitol/30 EO tetraoleate monolaurate and sorbitol/40 EO septaoleate. A novel antistat-surfactant found to be useful was sorbitan tripelargonate adduct with 10 moles of ethylene oxide.

In addition to the cold temperature wicking noted above, the finishes of this invention on nylon fiber and on nylon tire yarn, in particular, provide a surprisingly excellent balance of properties, including but not limited to:

1. good operability during fiber or yarn manufacture;
2. low finish varnishing on heated surfaces;
3. acceptably low fuming during yarn or fiber preparation, during tire manufacture;
4. good pick-up of the RFL dip into the tire cord; and
5. good adhesion of the yarns/cords/cord fabric to rubber.

The most surprising property was the acceptable fuming, in light of the highly liquid character of DTS as evidenced by its pour point at very low temperatures.

TEST METHODS

Tire yarn samples were converted into tire cord before testing for dip pick-up (DPU), wicking of dip, and hot 2-ply adhesion.

DIP PICKUP

Dip pickup (DPU) is determined by placing a dried and weighed sample (about 0.8 g.) of dipped cord (cut to about ½ inch lengths) in 100 ml of 90% Formic acid, refluxing 20–30 minutes to dissolve the nylon fiber, filtering off the undissolved RFL dip, rinsing with water and methanol, drying and weighing residual RFL dip. % DPU=100X (Wt. of Residual RFL Dip/Wt. of Dried Dipped Cord Sample-Wt. of Residual RFL Dip))

WICKING OF DIP

Wicking experiments of dip materials were run in a cold room at 0° C. The greige cords, 1890/1/2 (8.1×8.1 tpi), and dip were conditioned in the cold room at least 16 hours before testing. A 750 g. weight (brass) was suspended from a loop in the greige cord and the weight and lower portion of the vertically mounted cord were immersed in the dip. The wicking values reported are the heights in mm above the liquid surface level of the dip that the dip materials reached in the cords. The RFL dip was D5A containing 15% solids and a small quantity of carbon black. D5A is a mixture of resorcinol and formaldehyde resin with latex. The resin is prepared by mixing resorcinol with formaldehyde in aqueous sodium hydroxide at room temperature (mole rate of recorcinol to formaldehyde is 1 to 2). The resin is then mixed with a latex comprised of styrene/-butadiene/vinylpyridine terpolymer at room temperature (weight ratios of latex to resin is 6 to 1). Further details on the composition of D5A are available in the bulletin on "Gen-Tac" Vinylpyridine Latex; Chemical Plastics Div., General Tire Co., Akron, Ohio; p. 3, Form 7055-4-70-3M. The D5A dip containing carbon is called D5C. The carbon is a visual aid in detecting wicking.

HOT, TWO-PLY STRIP ADHESION TEST

The test utilized was the same as ASTM Test D-4393-85, Strip Peel Adhesion of Reinforcing Cords or Fabrics to Rubber Compounds (pages 1133–1142; 1985 Annual Book of ASTM Standards, Section 7, Volume 7.01) with a few modifications. The particular variation used was to test individual tire cords, 1260 denier/2 ply or 1890 denier/2 ply, that had been RFL dipped singly. The rubber stock employed was a combination of natural rubber (80 parts by weight), styrene/butadiene rubber (20 parts), N351 Black (35 parts), plus minor amounts of other conventional ingredients. The rubber was of such a quality that after curing at 160° C. for 20 minutes, it had the following characteristics: 300% modulus of 1250–1550 psi; tensile strength of about 3400 psi; elongation to break of 500%; and hardness (Shore Type A Durometer) of about 60. The 1260/1/2 tire cords were warped at 36 ends/inch, while the 1890/1/2 cords were warped at 32 ends/inch (vs. 24 in D-4393-85). After embedment of the cords in rubber stock (15 mil stock for 1260/1/2 cord and 24 mil stock for 1890/1/2 cord), the sample was cured at 160° C. +/−2° C. for 20 minutes at 62 kN pressure. Since hot adhesion was desired, the samples were heated in the Instron oven at 120° C. +/−2° C. for 25 +/−5 minutes prior to testing. The separation force was based on Option 1 (the mid-line between the high and low peaks of separation force). Four samples per item were tested and the results were reported as average force in pounds per inch.

EXAMPLES

CONTROL 1

Freshly spun filament yarn of polyhexamethylene adipamide of 70 relative viscosity as measured in U.S. Pat. No. 2,385,890 and containing 64 parts per million copper as a stabilizer in the form of a cupric salt was two-stage drawn (5.2–5.5x), annealed 220°–228° C.), relaxed (5–7%) and wound according to the process described in U.S. Pat. No. 3,311,691. Finish (1.2 weight percent based on weight of yarn) was applied to the yarn as a neat oil at about 75° C. via a kiss roll applicator located at the bottom of the spinning chimney, just before the feed roll; this is usually referred to as the "spin" finish. The principle ingredient of the "spin" finish (67 wt. % on wt. of finish) was the lubricant, coconut oil, which has an m.p. of 24°–27° C. The other finish ingredients were polyoxyethylene non-ionic surfactants (30 wt. %) and a hindered phenolic antioxidant (3 wt.%). The tire yarn so produced was 1890 denier and contained 280 filaments. It had a typical tire yarn tenacity of 9.8 g/den. as measured with 2.5 tpi yarn twist.

The above tire yarn was converted into a conventional 2-ply 1890/1/2 tire cord (singles twist=8.1 "Z" tpi; cable twist=8.1 "S" tpi) and processed on a multi-end, 3-oven hot stretching unit using the following process parameters in ovens 1/2/3: temperature=120° C./235° C./230° C.; exposure time=107/35/54 seconds; applied stretch=7.3/1.5/−2.0%. Cords were passed through a resorcinol-formaldehyde-latex (D5A) dip (15% dip solids) under ambient conditions (21°–27° C.) before entering the first oven. The dipped and stretched cord so prepared was characterized in terms of dip pickup (DPU) and hot two-ply adhesion. See Table 2 for the data.

The greige 2-ply tire cord (before dipping and stretching) was also characterized for wicking of RFL dip in a cold room at 0° C.; the data are plotted in FIG. 1.

Although Control 1 was an excellent tire cord in most respects, it gave lower than desired hot two-ply adhesion and wicking of dip materials.

EXAMPLE 1

This Example describes the preparation of a series of polyhexamethylene adipamide tire cords which showed substantial advantages over Control 1 in terms of low-temperature wicking & hot 2-ply adhesion.

Five different Samples, A-E, of polyhexamethylene adipamide tire yarns were prepared in the same manner as Control 1 above, except that different spin finishes were utilized. All five finishes contained low-melting ditridecyl sebacate (pour point $<-50°$ C.) as the lubricant, but the surfactant-antistat was altered in kind or amount in each of the finishes. Three of the finishes (Samples C, D & E) contained a novel surfactant-antistat, sorbitan tripelargonate 10 EO. Each finish also contained minor amounts of other optional ingredients. The finish compositions are shown in Table 1, while finish on yarn (FOY) is given in TABLE 2.

The tire yarns prepared as above had typical tensiles (tenacities=9.4–10.1 gpd; elongations at break=-18–20%) and were converted to tire cords in the same manner as for Control 1. The cords so prepared were tested with Control 1 for dip pickUp (DPU; see Table 2), Hot 2-Ply Adhesion (see Table 2) and Wicking of Dip Materials (see FIG. 1).

Samples A-E of Example 1 all gave noticeably improved hot, 2-ply adhesion vs. Control 1, ranging from 18–38% improvement when D5A Dip with 15% solids was used to 150–200% improvement when D5A Dip with 5% solids was used. The wicking rates at 0° C. show that Samples A-E have at least a several fold advantage over Control 1.

TABLE 1

| | Example 1 | | | | |
|---|---|---|---|---|---|
| | Sample A | Sample B | Sample C | Sample D | Sample E |
| Finish Ingredients | | | | | |
| Ditridecyl Sebacate | 67.4 | 66.7 | 66.7 | 67.0 | 57.0 |
| Sorbitol/30 EO/ 1 Lauric Acid/ 4 Oleic Acid | 19.7 | — | — | — | — |
| Sorbitol/40 EO/ 7 Oleic Acid | 9.9 | — | — | — | — |
| Sorbitan Trioleate/ 20 EO | — | 29.3 | — | — | — |
| Sorbitan Tripelargonate/10 EO | — | — | 29.3 | 30.0 | 40.0 |
| 4,4'-Butylidene-bis-(6-t-Butyl-m-Cresol) | 3.0 | 3.0 | 3.0 | 3.0 | 3.0 |
| Phenylmethyl Dimethyl Polysiloxane | — | 1.0 | 1.0 | — | — |
| Dimethyl Polysiloxane | — | — | — | 0.02 | 0.02 |
| Demineralized Water | 1.9 | — | — | — | — |
| Finish Performance | | | | | |
| Smoke Point, °C. | 153° | 169° | 168° | 159° | 162° |
| Viscosity @ 75° C., cps | 15.8 | 16.4 | 14.1 | 13.7 | 14.9 |
| Varnish - 112 Hours @ 220° C.,% | — | 4.7 | 2.6 | 2.6 | 1.4 |

Values in Table are wt. % of ingredient in finish.

TABLE 2

| | YARN FOY | TIRE CORDS | | |
|---|---|---|---|---|
| | | | 120° C. 2-PLY ADHESION | |
| | % | DPU, % | LBS/END | APP. RATING |
| 15% D5A SOLIDS DIP BATH | | | | |
| Control 1 | 1.2 | 2.2 | 32 | 2.7 |
| Example 1 - Sample A | 1.2 | 3.9 | 41 | 4.0 |
| Example 1 - Sample B | 0.9 | 4.1 | 44 | 3.3 |
| Example 1 - Sample C | 1.1 | 4.0 | 43 | 2.8 |
| Example 1 - Sample D | 1.1 | 4.2 | 40 | 2.8 |
| Example 1 - Sample E | 1.5 | 3.6 | 38 | 2.9 |
| 5% D5A SOLIDS DIP BATH | | | | |
| Control 1 | 1.2 | 1.4 | 11 | 1.0 |
| Example 1 - Sample A | 1.2 | 1.3 | 33 | 3.8 |
| Example 1 - Sample B | 0.9 | 1.5 | 35 | 3.9 |
| Example 1 - Sample C | 1.1 | 1.6 | 32 | 3.1 |
| Example 1 - Sample D | 1.1 | 1.5 | 28 | 2.5 |
| Example 1 - Sample E | 1.5 | 1.8 | 28 | 1.7 |

Appearance Rating (5.0 = complete rubber coverage, 1.0 = no rubber coverage)

I claim:

1. A fiber finish especially suitable for tire yarns comprising 50–95 wt. % of the finish being lubricants having a melting point not greater than about 12° C. wherein at least 40 wt. % of the lubricants is ditridecyl sebacate, 5–50 wt. % of the finish being a total antistat and surfactant, 0–5 wt. % of the finish being antioxidant and 0–2 wt. % of the finish being a polysiloxane.

2. A polyamide yarn especially suitable as a tire yarn having 0.2–2% finish comprising the finish of claim 1.

3. The yarn of claim 2 having a hot (120° C.) 2-ply adhesion of greater than 20 lbs. per inch at 5% dip pick-up.

4. The finish of claim 1 wherein 100% of the lubricant is ditridecyl sebacate.

5. The yarn of claim 2 wherein the polyamide yarn is polyhexamethylene adipamide.

6. The finish of claim 1 wherein the total antistat and surfactant is sorbitan tripelargonate adduct having 10 moles ethylene oxides.

* * * * *